US005468171A

United States Patent [19]

Taylor

[11] Patent Number: 5,468,171

[45] Date of Patent: Nov. 21, 1995

[54] PORTABLE PUPPET THEATER SYSTEMS

[76] Inventor: Roy Taylor, P.O. Box 192, Moncton, New Brunswick, Canada, EIC 8K9

[21] Appl. No.: 326,921

[22] Filed: Oct. 21, 1994

[51] Int. Cl.[6] ..... A63J 19/00

[52] U.S. Cl. ..... 446/82; 446/75

[58] Field of Search ..... 446/82–84, 75, 446/81, 73; 472/75

[56] References Cited

U.S. PATENT DOCUMENTS

| | | | |
|---|---|---|---|
| 1,800,948 | 4/1931 | McHugh | 446/82 |
| 2,837,863 | 6/1958 | Duvall | 446/82 X |
| 3,899,168 | 8/1975 | Besherse | 446/82 X |
| 5,085,609 | 2/1992 | Haberle | 446/83 |

*Primary Examiner*—Mickey Yu

[57] ABSTRACT

A portable puppet theater system including: a vertically disposed first front section having a rectangular configuration having an enlarged opening therethrough; a vertically disposed second rear section in a rectangular configuration having a periphery generally corresponding to that of the first section; a pair of side bars pivotably coupling the sides of the front section and rear section, the side bars also being pivotable at the centers thereof, to allow the front and rear sections to be moved toward each other for a collapsed orientation and away from each other for an operative orientation; a pelmet positioned across the upper edge of the opening with side curtains at the sides of the opening movable between a closed position in contact with each other and an open position allowing viewing through the opening; a plurality of lights located adjacent the upper edge of the opening; a tape player located adjacent to the lower edge of the opening; speakers mounted on the front face of the front section beneath the opening; a microphone operatively coupled to the speakers; a control panel on the back face of the front section for controlling the lights and the microphone along with a tape player; and a porous see-through backdrop constituting the central extent of the rear sections.

3 Claims, 4 Drawing Sheets

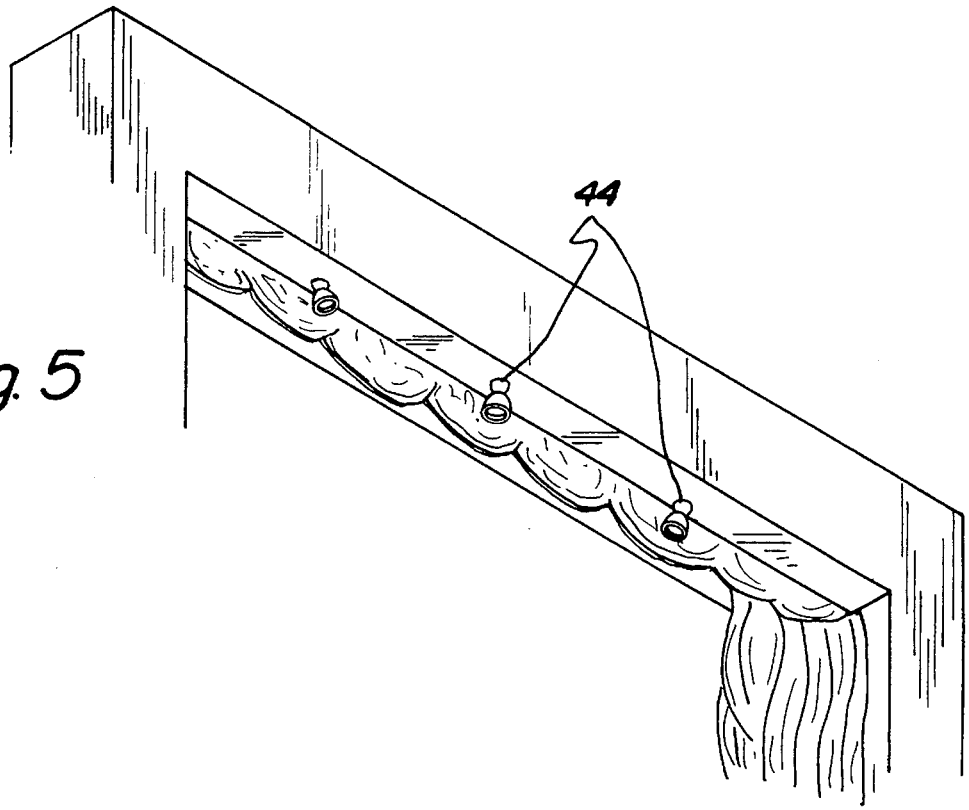
Fig. 5
Fig. 6
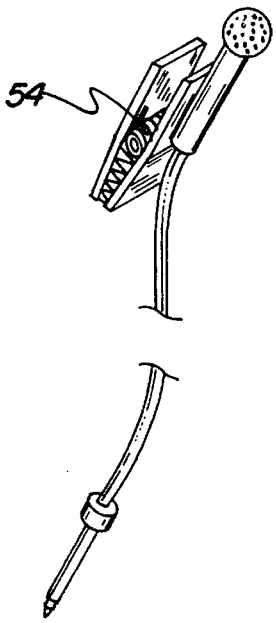

PORTABLE PUPPET THEATER SYSTEMS

BACKGROUND OF THE INVENTION

1. Field of the Invention

The present invention relates to portable puppet theater systems and more particularly pertains to entertaining and educating audiences through puppet shows which on stages which are readily collapsible.

2. Description of the Prior Art

The use of providing entertainment and education through a puppet theater which is readily collapsible for being transported from location to location is known in the prior art. More specifically, providing entertainment and education through a puppet theater which is readily collapsible for being transported from location to location heretofore devised and utilized for the purpose of conducting puppet shows are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 3,699,703 a puppet theater.

U.S. Pat. No. 3,762,788 discloses a convertible container puppet theater.

U.S. Pat. No. 4,804,348 discloses an animated toy puppet theater.

U.S. Pat. No. 4,857,028 discloses a portable puppet theater kit.

U.S. Pat. No. 5,085,609 discloses a puppet theater with sound track and cued lights.

In this respect, the portable puppet theater systems according to the present invention substantially departs from the conventional concepts and designs of the prior art, and in doing so provides an apparatus primarily developed for the purpose of puppet theaters.

Therefore, it can be appreciated that there exists a continuing need for new and improved portable puppet theater systems which can be used for puppet theaters. In this regard, the present invention substantially fulfills this need.

SUMMARY OF THE INVENTION

In view of the foregoing disadvantages inherent in the known types of providing entertainment and education through a puppet theater which is readily now present in the prior art, the present invention provides improved portable puppet theater systems. As such, the general purpose of the present invention, which will be described subsequently in greater detail, is to provide a new and improved portable puppet theater systems and method which has all the advantages of the prior art and none of the disadvantages.

To attain this, the present invention essentially comprises a new and improved portable puppet theater system comprising, in combination: a vertically disposed first front section having a rectangular configuration having an enlarged opening therethrough; a vertically disposed second rear section in a rectangular configuration having a periphery generally corresponding to that of the first section; a pair of side bars pivotably coupling the sides of the front section and rear section, the side bars also being pivotable at the centers thereof, to allow the front and rear sections to be moved toward each other for a collapsed orientation and away from each other for an operative orientation; a pelmet positioned across the upper edge of the opening with side curtains at the sides of the opening movable between a closed position in contact with each other and an open position allowing viewing through the opening; a plurality of lights located adjacent the upper edge of the opening; a tape player located adjacent to the lower edge of the opening; speakers mounted on the front face of the front section beneath the opening; a microphone operatively coupled to the speakers; a control panel on the back face of the front section for controlling the lights and the microphone along with a tape player; a porous see-through backdrop constituting the central extent of the rear sections; and motor means coupled with respect to the curtains to draw them together or to separate them under the control of an operator.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved portable puppet theater systems which have all the advantages of the prior art providing entertainment and education through a puppet theater which is readily and none of the disadvantages.

It is another object of the present invention to provide new and improved portable puppet theater systems which may be easily and efficiently manufactured and marketed.

It is further object of the present invention to provide new and improved portable puppet theater systems which are of durable and reliable constructions.

An even further object of the present invention is to provide new and improved portable puppet theater systems which are susceptible of a low cost of manufacture with regard to both materials and labor, and which accordingly are then susceptible of low prices of sale to the consuming public, thereby making such portable puppet theater systems economically available to the buying public.

Still yet another object of the present invention is to provide new and improved portable puppet theater systems which provide in the apparatuses and methods of the prior art some of the advantages thereof, while simultaneously overcoming some of the disadvantages normally associated therewith.

Lastly, it is an object of the present invention to provide new and improved portable puppet theater system comprising: a vertically disposed first front section having a rectangular configuration having an enlarged opening therethrough; a vertically disposed second rear section in a rectangular configuration having a periphery generally corresponding to that of the first section; a pair of side bars pivotably coupling the sides of the front section and rear section, the side bars also being pivotable at the centers thereof, to allow the front and rear sections to be moved toward each other for a collapsed orientation and away from each other for an operative orientation; a pelmet positioned across the upper edge of the opening with side curtains at the sides of the opening movable between a closed position in contact with each other and an open position allowing viewing through the opening; a plurality of lights located adjacent the upper edge of the opening; a tape player located adjacent to the lower edge of the opening; speakers mounted on the front face of the front section beneath the opening; a microphone operatively coupled to the speakers; a control panel on the back face of the front section for controlling the lights and the microphone along with a tape player; and a porous see-through backdrop constituting the central extent of the rear sections.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is a perspective illustration of the lighting assembly as shown in FIG. 1.

FIG. 6 is a perspective view of the microphone adapted and used in association with the apparatus of the prior figures.

The same reference numerals refer to the same parts through the various Figures.

DESCRIPTION OF THE PREFERRED EMBODIMENT

Figure 1:
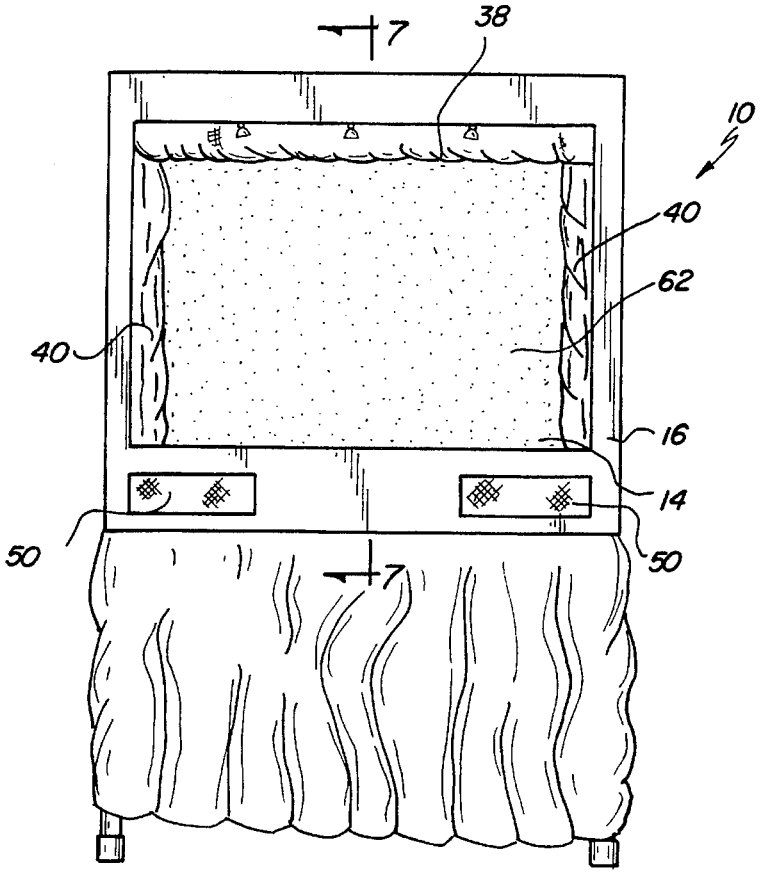
FIG. 1 is a front elevational view of the preferred embodiment of the new and improved portable puppet theater systems constructed in accordance with the principles of the present invention.
Figure 2:
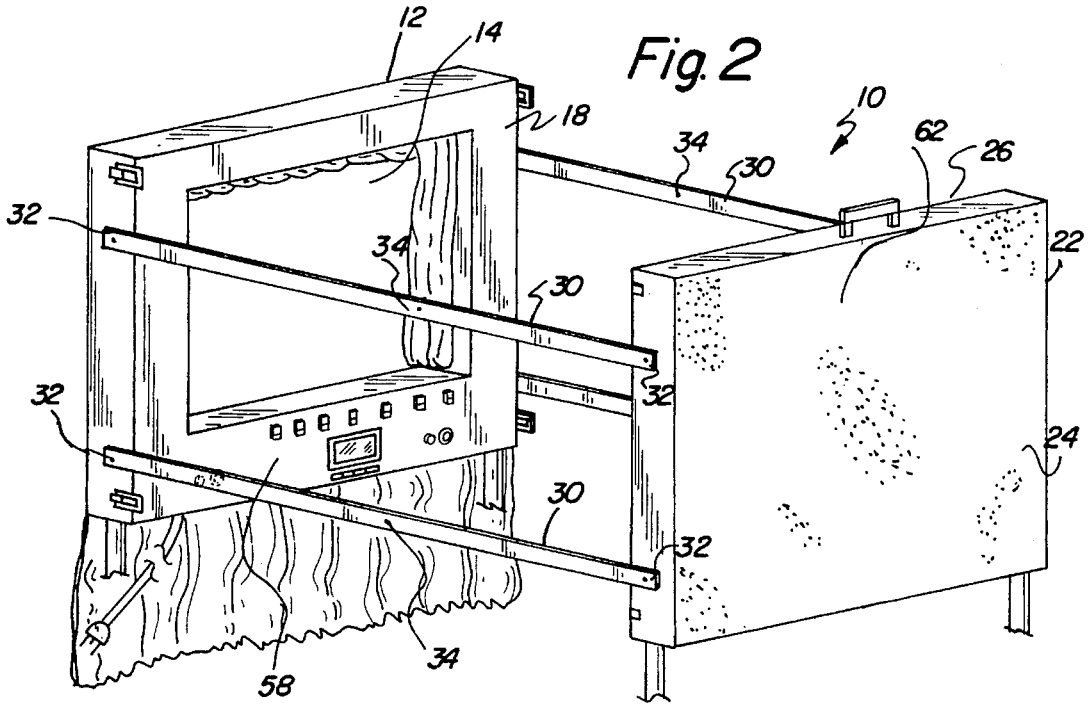
FIG. 2 is a perspective illustration of the device shown in FIG. 1.
Figure 3:
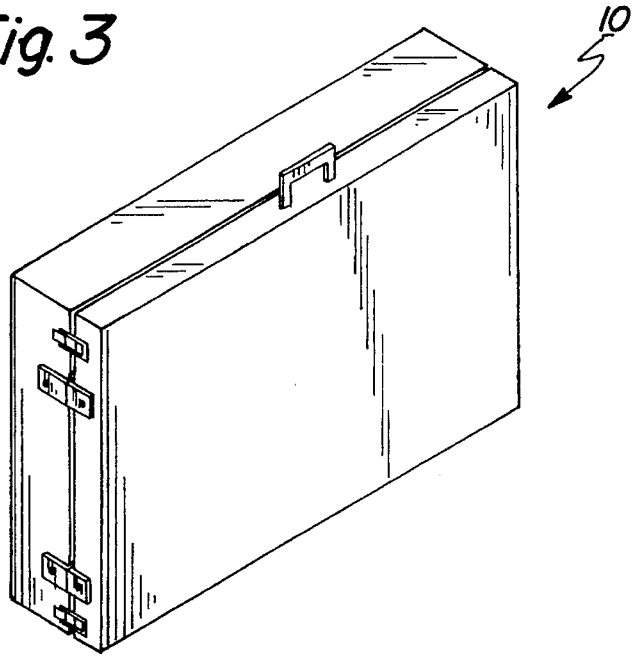
FIG. 3 is a perspective view of the device of the prior Figures but in the collapsed position for transportation.
Figure 4:
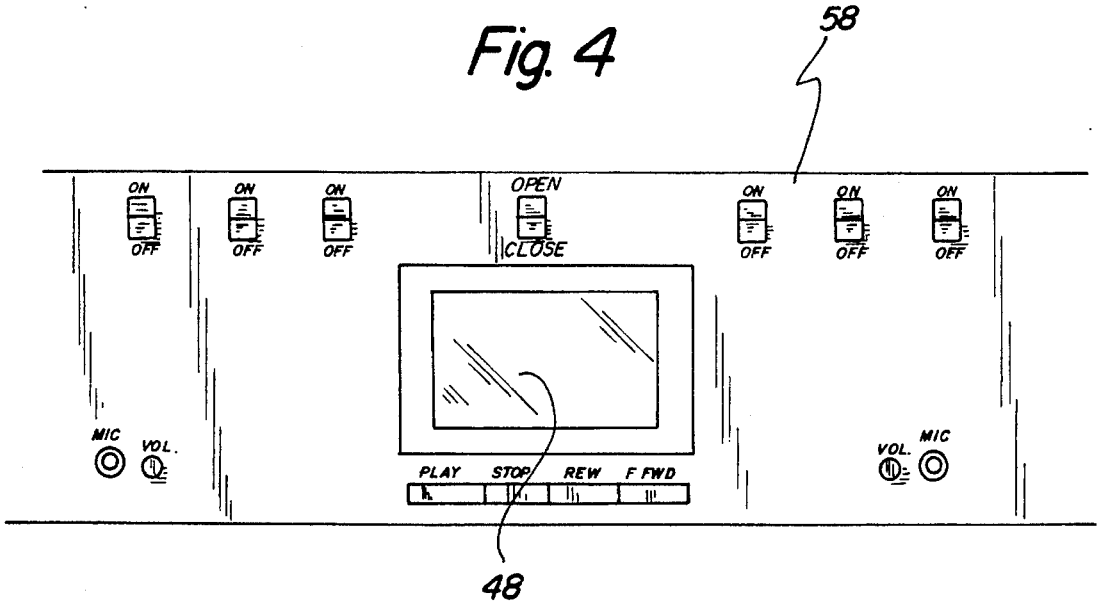
FIG. 4 is a front elevational view of the control panel as shown in FIG. 2.

With reference now to the drawings, and in particular to FIG. 1 thereof, the preferred embodiment of the new and improved portable puppet theater systems embodying the principles and concepts of the present invention and generally designated by the reference numeral 10 will be described.

The present invention, the new and improved portable puppet theater systems, is in effect a system 10 comprised of a plurality of components. In their broadest context, these components include a front section, a rear section, side bars therebetween, a pelmet, lights, a tape player, speakers, a microphone, a control panel, a porous see-through backdrop and, in an alternate embodiment, a motor for drawing the curtains. The individual components are specifically constructed and correlated with respect to each other to attain the intended objectives.

More specifically, the front section 12 is a vertically-disposed member. Its periphery is in a rectangular configuration. In addition, the front section has an enlarged opening 14 therethrough for allowing an audience on one side, the front side 16, to view the puppets on the other side, the back side 18.

The second major component of the system 12 is a second or rear section 22. Like the front section, the rear section is also adapted to be vertically disposed. The rear section has a periphery in a rectangular configuration of a size and shape corresponding to that of the front section. Such rear section is adapted to preclude viewing of puppeteers on the backside 24 thereof. The front side 26 is adapted to be viewed by the audience.

A pair of side bars 30 couple the sides of the front section and the rear section. Pivot pins 32 pivotally couple such sides to the side bars. In addition, a supplemental pivot pin 34 pivotally couples the centers of the side bars. This arrangement allows the side bars to be pivoted at their centers and at their ends. As a result, the front and rear sections may be moved toward each other for a collapsed orientation. They may also be moved away from each other for an operative position during use of the theater.

Positioned across the upper edge of the opening is a pelmet 38. Such pelmet is for decorative purposes. In addition, side curtains 40 each are provided at the sides of the openings. The curtains are moveable between a closed position in contact with each other to preclude viewing the puppets or puppeteers on the backside of the front section. The curtains are also movable to an opened position, opening the front section to allow viewing of the puppets by an audience through the opening.

A plurality of lights 46 are secured adjacent to the upper edge of the opening. Such lights allow illuminating of the puppets between the front and rear section.

The utility of the system 10 is extended through the use of audio support. Such audio support includes a tape player 48 located adjacent to the lower edge of the opening. Further, speakers 50 are mounted on the front face of the front section beneath the opening. This allows the audience to better hear the words of the puppeteer as well as any background music or sounds provided by the tape player. A microphone 54 is also utilized in association with the speakers. Such microphone is operatively coupled to the speakers to expand the audio capabilities of the system 10.

Located on the back face of the front section is a control panel 58. The control panel is operatively coupled to the light and the microphone along with the tape player. In this manner, the puppeteer or puppeteers may have control over the complete audio/video apparatus of the system 10.

The utility of the system is increased through the use of a porous see-through back drop 62. In the disclosed embodiment, such backdrop is formed of and constitutes the central extent of the rear section. The backdrop includes a plurality of small apertures of such size whereby when viewed by the audience through the opening, it will not be possible to see the puppeteers adjacent to the back face of the rear section. It will, however, allow the puppeteer or puppeteers to look through the rear section then the opening to view the puppets and audience. This is possible because the face and eyes of the puppeteer and puppeteers are closer to the apertures in the backdrop.

Figure 8:
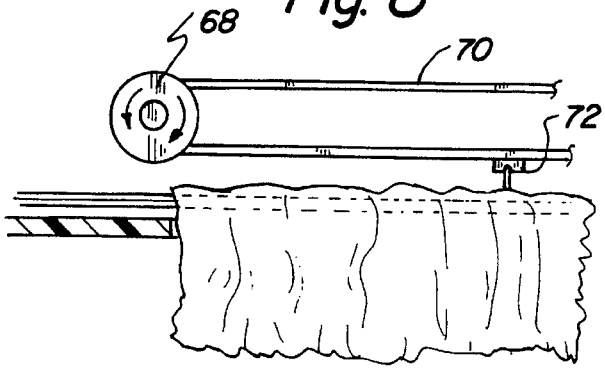
FIG. 8 is a cross-sectional view taken along lines 8—8 of FIG. 7.
Figure 7:
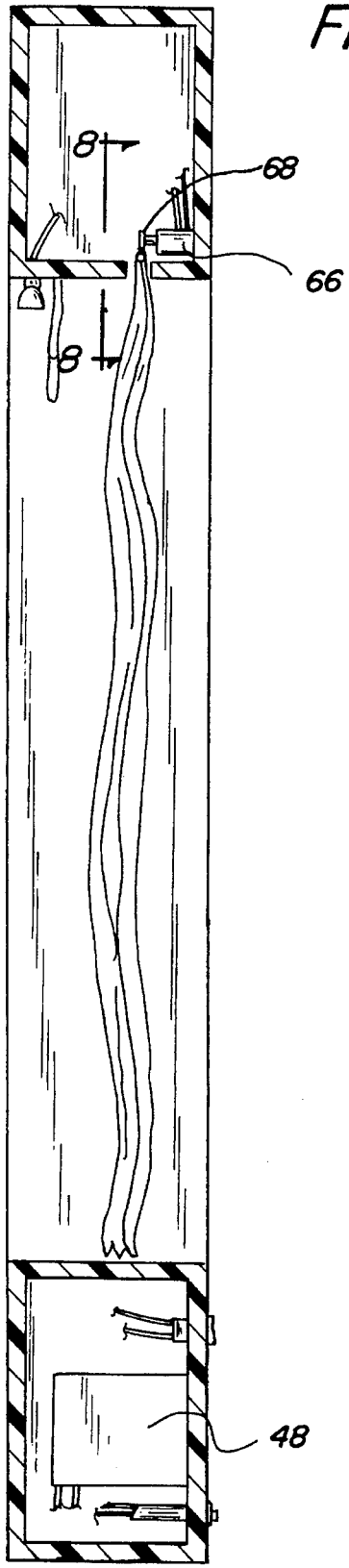
FIG. 7 is a cross-sectional view taken along lines 7—7 of FIG. 1.

The final component of the system 10 as disclosed can be seen in FIGS. 7 and 8. This feature is an alternate embodiment of the invention. This feature includes a motor 66. The motor 66 is driven through controls under the control of an operator. In association therewith are a pair of pulleys 68. The pulleys support a loop of inextensible material 70 therebetween. Attachment members 72 couple the material of the loop to the curtain. In this manner, when an operator activates the motor through a suitable switch, the curtains will move between a closed position over the opening and an opened position to allow viewing through the opening of the first section.

The importance of the present invention's appeal is that it revolves around a theme which has been used as the cornerstone of development for virtually all children's toys and games, the element of role playing. From simple, traditional toys such as dolls and tea sets to more modern and sophisticated ones, the role-playing theme has remained strong and consistent throughout the years. It is an important fundamental of child development for which these toys can be used as a vehicle.

The present invention, however, would allow a child to enjoy the fun and entertainment of a toy while developing creative and artistic skills. With the aid of parents or educators, the present invention could also be used as a learning tool. It naturally encourages interaction and participation, even among timid, less confident children.

The present invention is designed to interest children in presenting their own ideas on stage. It would be built as a basic economy model with additional accessories to expand it into a deluxe model.

The present invention is made of plastic and would be approximately 36 inches wide by 30 inches high and 36 inches deep. This size theater would accommodate 1 or 2 operators, a larger version, 48 inches wide would accommodate 3 operators. The theater would consist of a stage, complete with a lighting system, sound system, curtains, pelmet and backdrop.

The lighting system of the present invention would shine on the main draw curtains when closed, and also provide front lighting for the puppets when the draw curtains are opened. Battens shine on backdrops or can be used for special effects. Lighting switches would be located at the back of the stage, operable by the puppeteers.

The sound system of the present invention is composed of two speakers located under the stage at the front. Amplifier and controls would be built into the stage at the back and operable by the puppeteers. The puppeteers would wear clip-on microphones which plug into sockets built into the back of the stage and are connected to the amplifier. There would also be sockets for plug-in tape recorders, operable by the puppeteers. Tape recorders could also be built into the stage.

The curtains of the present invention consist of two main draw curtains and a pelmet. The curtains would be operable by the puppeteers turning a handle located at the back of the stage. An electric forward-reverse motor could also be mounted under the stage.

The backdrops of the present invention are made from porous see-through material that allows the puppeteer to see the operation of the puppets on stage. This material also hides the puppeteer from the view of the audience. The material can be painted with water color paints, allowing the children to use their own imaginations.

Perhaps the greatest advantage of the present invention is its portability. When the back and front sections are closed together they would be held by four catches located at the top and bottom on the sides. Carry handles would also be located on the sides. Depth, if required, could also be adjusted for adult puppeteers. The back section would have built-in storage areas for puppets and accessories.

The present invention in its basic embodiment would include one set of front stage curtains, one backdrop painted with a natural scene, two puppets, two puppet costumes, one set of front stage lighting, amplifier system with two speakers, four adjustable support legs, a fasten-on cover for the front of the theater and an instruction manual. Another possible addition could contain kits to make one's own puppets and costumes.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved portable puppet theater system comprising, in combination:

a vertically disposed first front section having a rectangular configuration having an enlarged opening therethrough;

a vertically disposed second rear section in a rectangular configuration having a periphery generally corresponding to that of the first section;

a pair of side bars pivotably coupling the sides of the front section and rear section, the side bars also being pivotable at the centers thereof, to allow the front and rear sections to be moved toward each other for a collapsed orientation and away from each other for an operative orientation;

a pelmet positioned across the upper edge of the opening with side curtains at the sides of the opening movable between a closed position in contact with each other and an open position allowing viewing through the opening;

a plurality of lights located adjacent the upper edge of the opening;

a tape player located adjacent to the lower edge of the opening;

speakers mounted on the front face of the front section beneath the opening;

a microphone operatively coupled to the speakers;

a control panel on the back face of the front section for controlling the lights and the microphone along with the tape player;

a porous see-through backdrop constituting the central extent of the rear section; and motor means coupled with respect to the curtains to draw them together or to separate them under the control of an operator.

2. A portable puppet theater system comprising:

a vertically disposed first front section having a rectangular configuration having an enlarged opening therethrough;

a vertically disposed second rear section in a rectangular configuration having a periphery generally corresponding to that of the first section;

a pair of side bars pivotably coupling the sides of the front section and rear section, the side bars also being pivotable at the centers thereof, to allow the front and rear sections to be moved toward each other for a collapsed orientation and away from each other for an operative orientation;

a pelmet positioned across the upper edge of the opening with side curtains at the sides of the opening movable between a closed position in contact with each other and an open position allowing viewing through the opening;

a plurality of lights located adjacent the upper edge of the opening;

a tape player located adjacent to the lower edge of the opening;

speakers mounted on the front face of the front section beneath the opening;

a microphone operatively coupled to the speakers;

a control panel on the back face of the front section for controlling the lights and the microphone along with the tape player; and a porous see-through backdrop constituting the central extent of the rear section.

3. The device as set forth in claim 2 and further including:

motor means coupled with respect to the curtains to draw them together or to separate them at the will of an operator.

* * * * *